US009862535B2

(12) United States Patent
Christianson et al.

(10) Patent No.: US 9,862,535 B2
(45) Date of Patent: Jan. 9, 2018

(54) OVERCAP ASSEMBLY

(71) Applicant: S. C. Johnson & Son, Inc., Racine, WI (US)

(72) Inventors: Jeffrey J. Christianson, Oak Creek, WI (US); Kylie L. Levake, Union Grove, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 15/043,034

(22) Filed: Feb. 12, 2016

(65) Prior Publication Data

US 2017/0233171 A1 Aug. 17, 2017

(51) Int. Cl.

| | |
|---|---|
| ***B65D 83/00*** | (2006.01) |
| ***B65D 83/20*** | (2006.01) |
| ***B65D 83/30*** | (2006.01) |
| ***B65D 1/02*** | (2006.01) |

(52) U.S. Cl.

CPC ..... *B65D 83/205* (2013.01); *B65D 1/0223* (2013.01); *B65D 83/207* (2013.01); *B65D 83/30* (2013.01)

(58) Field of Classification Search

CPC .... B65D 83/205; B65D 83/207; B65D 83/30; B65D 1/0223

USPC ..... 222/402.13, 402.1, 402.11, 321.8, 182, 222/153.11

See application file for complete search history.

(56) References Cited

U.S. PATENT DOCUMENTS

| | | | | |
|---|---|---|---|---|
| 6,302,302 | B1 * | 10/2001 | Albisetti | B65D 83/205 222/153.11 |
| 7,036,691 | B2 * | 5/2006 | Nicolas | B65D 83/206 222/153.11 |
| 7,121,434 | B1 | 10/2006 | Caruso | |
| 2004/0112924 | A1 | 6/2004 | Albisetti | |
| 2013/0037582 | A1 * | 2/2013 | Andersen | B65D 83/206 222/402.13 |

FOREIGN PATENT DOCUMENTS

| | | | |
|---|---|---|---|
| EP | 0105202 | A1 | 4/1984 |
| EP | 2955385 | A1 | 3/2016 |
| FR | 1562239 | A | 4/1969 |
| GB | 980662 | A | 1/1965 |
| KR | 20110128672 | A | 11/2011 |

OTHER PUBLICATIONS

International Search Report and Written Opinion dated May 10, 2017, cited in corresponding PCT application PCT/US2017/016843 (9 pages).

* cited by examiner

*Primary Examiner* — Lien Ngo

(57) ABSTRACT

An overcap assembly includes an actuator having a first slot, a tab, and a spray passageway. A nozzle is in fluid communication with the spray passageway. A housing is also included having a notch to receive the tab during a non-actuation state and a first projection to be received by the first slot during an actuation state.

19 Claims, 14 Drawing Sheets

OVERCAP ASSEMBLY

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Invention

The present invention relates generally to an overcap assembly including a housing and, more particularly, to an actuator for use with the housing.

2. Description of the Background of the Invention

Pressurized containers are commonly used to store and dispense volatile materials, such as air fresheners, deodorants, insecticides, germicides, decongestants, perfumes, and the like. The volatile materials are typically stored in a pressurized and liquefied state within the container. The product is forced from the container through an aerosol valve by a hydrocarbon or non-hydrocarbon propellant. A release valve with an outwardly extending valve stem may be provided to facilitate the release of the volatile material at a top portion of the container, whereby activation of the valve via the valve stem causes volatile material to flow from the container through the valve stem and into the outside atmosphere. The release valve may typically be activated by tilting, depressing, or otherwise displacing the valve stem. A typical valve assembly includes a valve stem, a valve body, and a valve spring. The valve stem extends through a pedestal, wherein a distal end extends upwardly away from the pedestal and a proximal end is disposed within the valve body.

Pressurized containers frequently include an overcap that covers a top end of the container. Typical overcaps are releasably attached to the container by way of an outwardly protruding ridge, which circumscribes the interior lower edge of the overcap and interacts with a bead or seam that circumscribes a top portion of the container. When the overcap is placed onto the top portion of the container, downward pressure is applied to the overcap, which causes the ridge to ride over an outer edge of the seam and lock under a ledge defined by a lower surface of the seam.

Typical overcaps include a mechanism for engaging the valve stem of the container. Some actuator mechanisms may include linkages that apply downward pressure to depress the valve stem and open the valve within the container. Other actuating mechanisms may instead apply radial pressure where the container has a tilt-activated valve stem. In any case, these actuating mechanisms provide a relatively convenient and easy to use interface for end users.

Conventional actuating mechanisms include either an actuating button or an actuating trigger. Traditional actuating buttons have a discharge orifice situated within the button that defines a duct through which liquid product may pass. The duct is typically defined to lead and engage the valve stem of an associated container. Thus, when dispensement is desired, a user may depress the actuator button, which in turn depresses or tilts the valve stem and opens the valve within the associated container, thereby releasing the contents of the container through the discharge duct and out of the discharge orifice.

In other containers, the valve stem is tilted or displaced in a direction transverse to the longitudinal axis to radially actuate the valve stem. When the valve assembly is opened, a pressure differential between the container interior and the atmosphere forces the contents of the container out through an orifice of the valve stem.

Numerous problems arise with prior art actuation systems utilized in combination with containers having a relatively small neck. In particular, many prior art actuators, such as actuator buttons, utilize a hinged actuator design in the overcap. However, because smaller container necks have a smaller overcap footprint, it is difficult to effectively utilize a hinged actuator in the overcap. An effective, easily assembled, and longitudinally displaceable overcap assembly is therefore needed for use with containers having necks with a smaller footprint.

SUMMARY OF THE INVENTION

According to one aspect, an overcap assembly includes an actuator having a first slot, a tab, and a spray passageway. The assembly further includes a nozzle in fluid communication with the spray passageway and a housing having a notch to receive the tab during a non-actuation state, and a first projection to be received by the first slot during an actuation state.

According to a different aspect, an overcap assembly includes a housing having a sidewall. A dispensing orifice is provided within the sidewall and a first projection extends from the sidewall. A notch is also provided within the sidewall. The overcap assembly further includes an actuator having a first slot to receive the first projection during an actuation state, and a tab to be received by the notch during a non-actuation state.

According to another aspect, a method of seating an overcap assembly on a container includes the steps of providing a container with a valve stem and providing a housing having a dispensing orifice, a notch, and first and second projections extending therefrom. Another step includes providing an actuator, which includes a conduit with an outlet orifice and a valve seat, wherein first and second slots are disposed on opposite sides of the actuator, and wherein a tab is disposed on the actuator. The method further includes the step of positioning the first and second projections within the first and second slots, respectively, so that first and second flat faces of each projection are engageable with first and second stop faces of each slot to assist in inhibiting substantial vertical translation. The method also includes the step of mating the overcap to the container, whereby the valve stem is seated within the valve seat of the conduit.

DETAILED DESCRIPTION OF THE DRAWINGS

Figure 1:
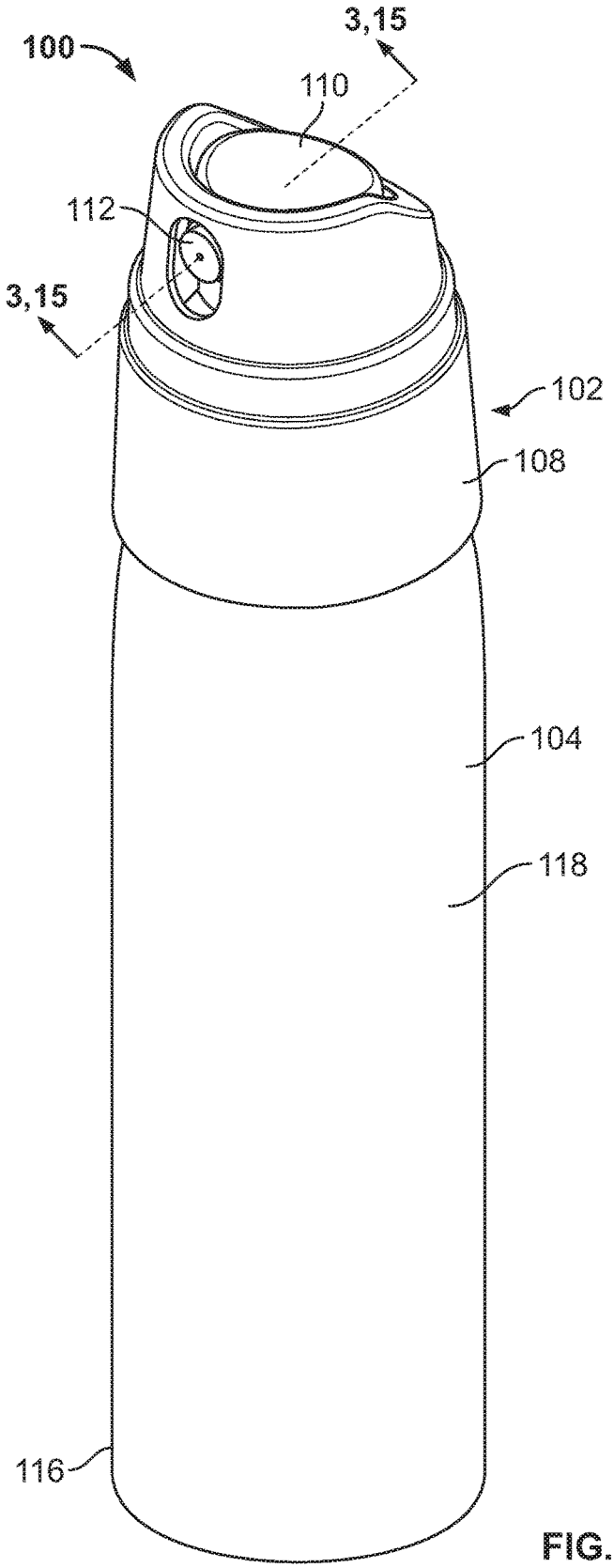
FIG. 1 is an isometric view of a dispensing system including an overcap assembly.

FIG. 1 depicts a product dispensing system 100 including an overcap assembly 102 and a container 104. The overcap assembly 102 includes a housing 108, an actuator 110, and a nozzle insert 112. The actuator 110 is at least partially disposed within the housing 108 and facilitates the product being dispensed from the dispensing system 100. In use, the overcap assembly 102 is adapted to release a product from the container 104 upon the occurrence of a particular condition, such as the manual activation of the actuator 110 by a user of the dispensing system 100. The product discharged may be a fragrance or insecticide disposed within a carrier liquid, a deodorizing liquid, or the like. The product may also comprise other actives, such as sanitizers, air fresheners, cleaners, odor eliminators, mold or mildew inhibitors, insect repellents, and/or the like, and/or that have aromatherapeutic properties. The product alternatively comprises any solid, liquid, or gas known to those skilled in the art that may be dispensed from a container. It is contemplated that the container 104 may contain any type of pressurized or non-pressurized product, such as compressed gas that may be liquefied, non-liquefied, or dissolved, including carbon dioxide, helium, hydrogen, neon, oxygen, xenon, nitrous oxide, or nitrogen. The container 104 may alternatively contain any type of hydrocarbon gas, including acetylene, methane, propane, butane, isobutene, halogenated hydrocarbons, ethers, mixtures of butane and propane, otherwise known as liquid petroleum gas or LPG, and/or mixtures thereof. The product dispensing system 100 is therefore adapted to dispense any number of different products.

The container 104 and/or overcap assembly 102 may each be independently made of any appropriate material, including multiple layers of the same or different material, such as a polymer, a plastic, metal such as aluminum, an aluminum alloy, or tin plated steel, glass, a cellulosic material, a laminated material, a recycled material, and/or combinations thereof. The container 104 and/or overcap assembly 102 may be formed from a wide variety of well known polymeric materials, including, for example, polyethylene (PE), low density polyethylene (LDPE), high density polyethylene (HDPE), polyethylene terephthalate (PET), crystalline PET, amorphous PET, polyethylene glycol terephthalate, polystyrene (PS), polyamide (PA), polyvinyl chloride (PVC), polycarbonate (PC), poly(styrene:acrylonitrile) (SAN), polymethylmethacrylate (PMMA), polypropylene (PP), polyethylene naphthalene (PEN), polyethylene furanoate (PEF), PET homopolymers, PEN copolymers, PET/PEN resin blends, PEN homopolymers, overmolded thermoplastic elastomers (TPE), fluropolymers, polysulphones, polyimides, cellulose acetate, and/or combinations thereof. It is further envisioned that the container 104 may include an interior and/or exterior lining or coating to further strengthen the container 104 structurally, as well as make the container 104 resilient to harsh chemicals. The lining(s) and/or coating (s) may be made of any one of the preceding polymeric materials or may further be made of ethylenevinyl alcohol (EVOH). The container 104 may be opaque, translucent, or transparent.

Figure 2:
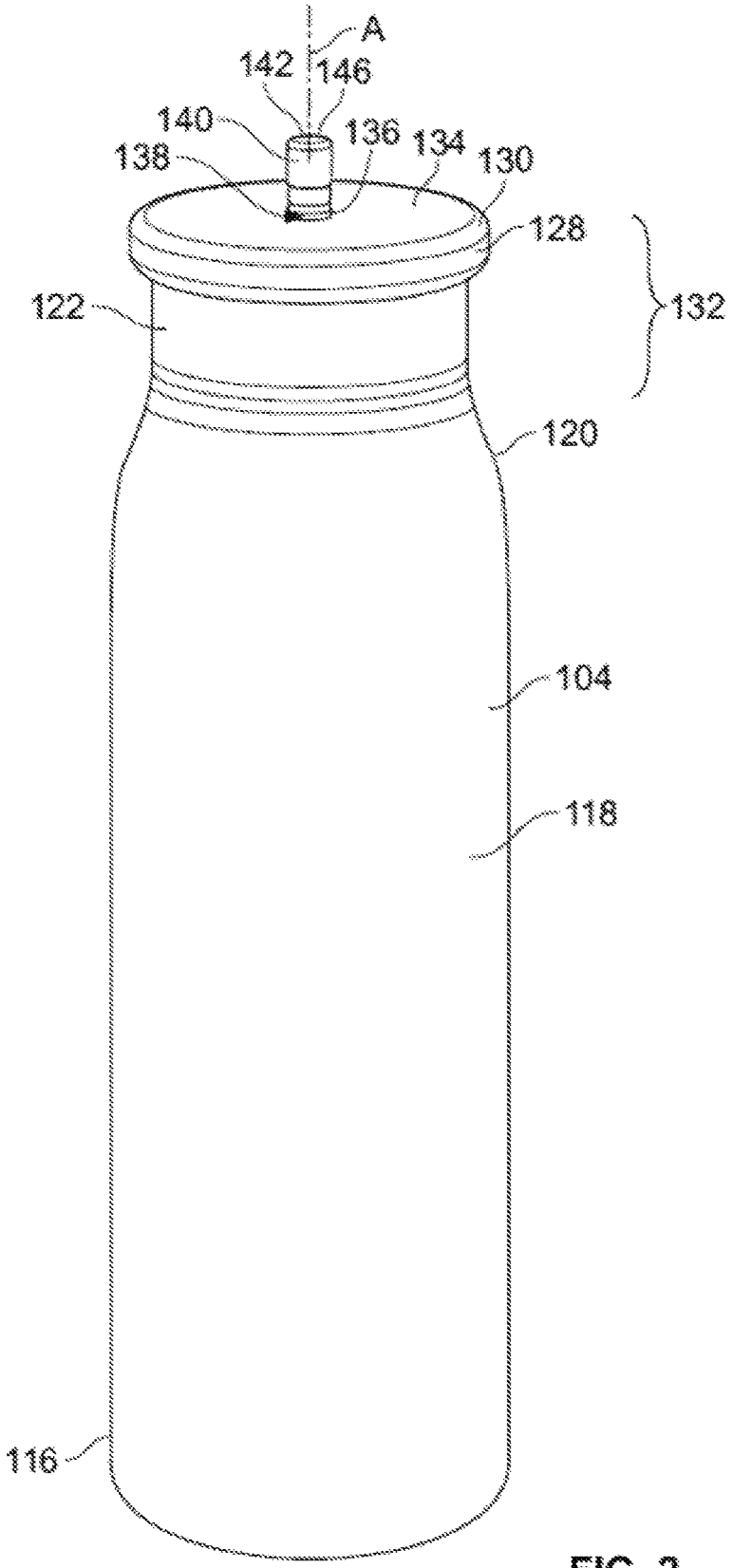
FIG. 2 is an isometric view of the dispensing system of FIG. 1 without the overcap assembly coupled thereto.

As best seen in FIG. 2, the container 104 includes a lower end 116 and a substantially cylindrical body 118, which terminates at a shoulder 120 of the container 104. The container 104 may alternatively include a body of any other shape, including a substantially tapered body 118. A neck 122 is disposed adjacent the shoulder 120 and below a seam, bead, or projection 128. The projection 128 is defined by rounded corners in the present embodiment and provides a location upon which the overcap assembly 102 may be attached to the container 104. It is contemplated that the container 104 of the present disclosure may be a conventional aerosol container, which includes features that are externally or internally crimped to portions of the body 118, the shoulder 120, the neck 122, and/or the projection 128. For example, as illustrated in FIG. 2, a mounting cup or crown 130 may be externally crimped to the container 104 over the projection 128. The projection 128 need not be part of an internally or externally crimped portion, however, and could be alternatively molded, extruded, or otherwise added to the container 104, such as by glue or an adhesive, to assist in retaining and/or engaging with the overcap assembly 102. Further, the projection 128 could be ultrasonically welded, spin welded, or laser welded to the crown 130.

Still referring to FIG. 2 the neck 122 and the projection 128 define a finish 132 of the container 104. The finish 132 is generally circular-shaped and terminates at the crown 130. The crown 130 of the container 104 includes a generally planar surface 134 that is centrally interrupted by a pedestal 136. The pedestal 136 extends upwardly from a central portion 138 of the crown 130. A conventional valve assembly (not shown in detail) includes a valve stem 140, which is connected to a valve body (not shown) and a valve spring (not shown) disposed within the container 104. The valve stem 140 extends upwardly through the pedestal 136, wherein a distal end 142 extends upwardly away from the pedestal 136 and is adapted to interact with the actuator 110 disposed within the overcap assembly 102. A longitudinal axis A extends through the valve stem 140.

It is also contemplated that other types of containers 104 or bottles may be used with the overcap assembly 102 disclosed herein. While the presently disclosed overcap assembly 102 exhibits particular advantages with containers having a small footprint, it is contemplated that the present overcap assembly could be used with other types of known containers. Further, such containers may broadly encompass any type of container adapted to hold an aerosolized substance or fluid and may be adapted for use as a standalone container and/or with a base or other dispenser housing.

Figure 3:
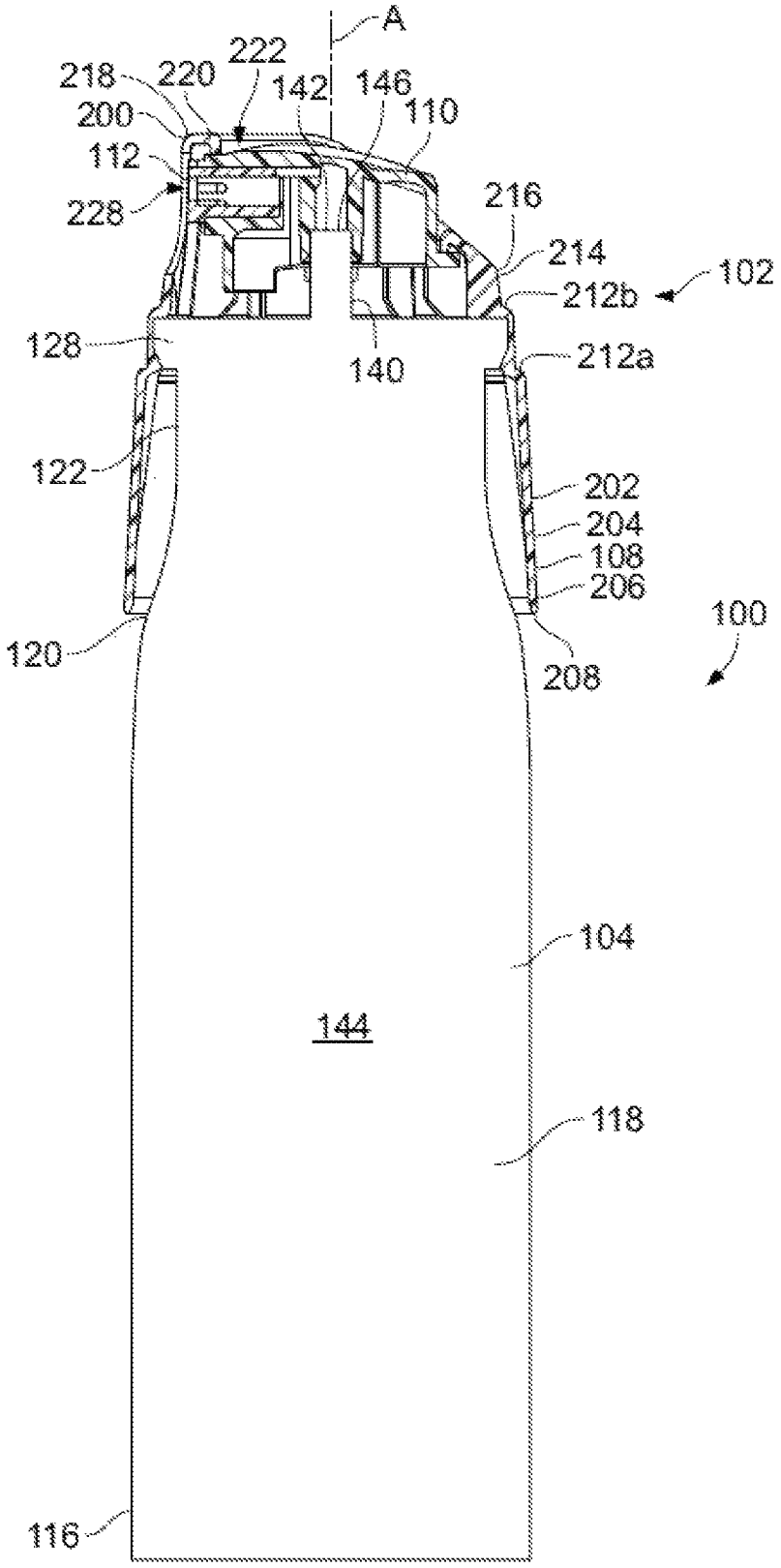
FIG. 3 is a partial cross-sectional side view of the dispensing system of FIG. 1 taken along the line 3-3 of FIG. 1.
Figure 4:
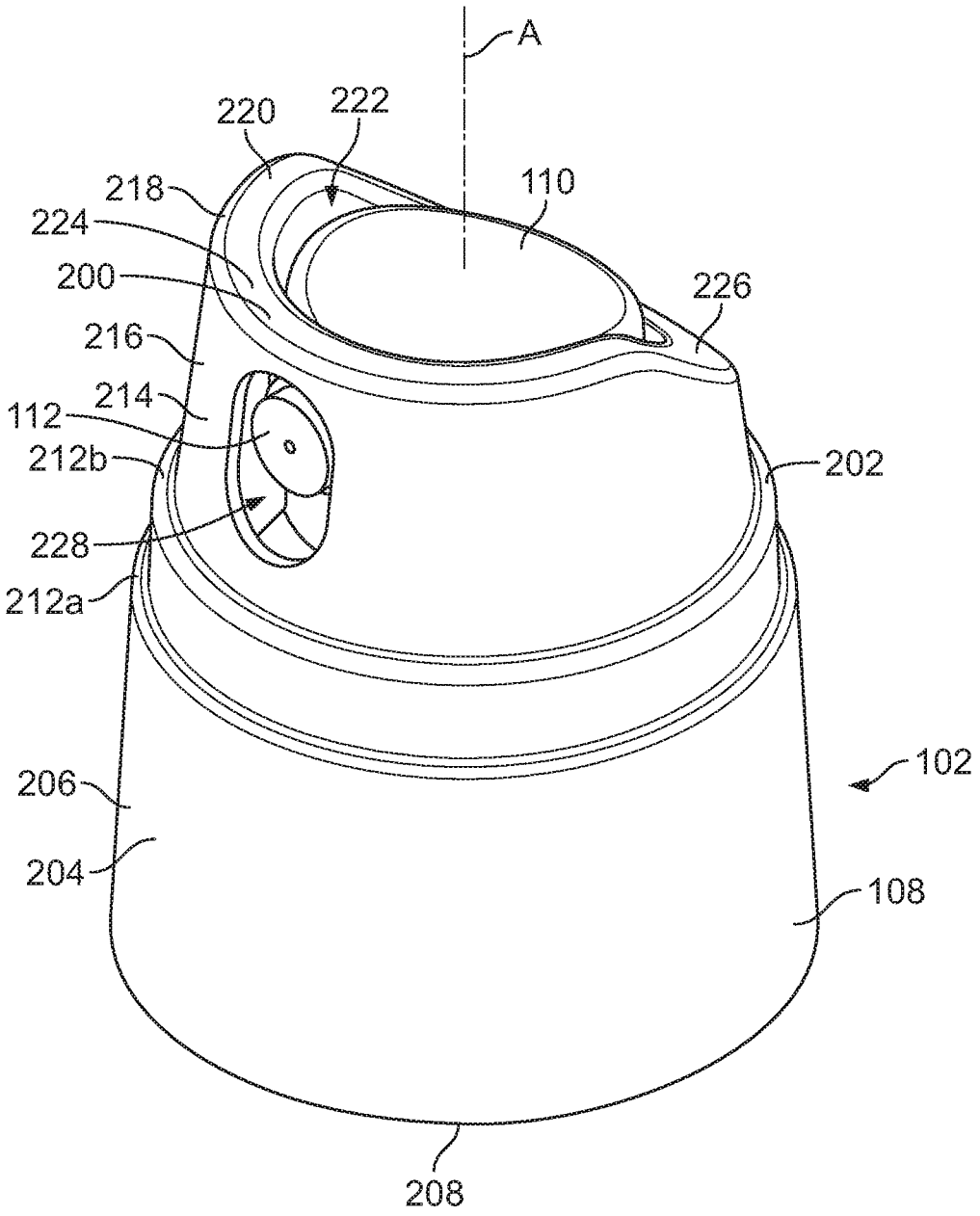
FIG. 4 is a top front isometric view of an overcap assembly.
Figure 5:
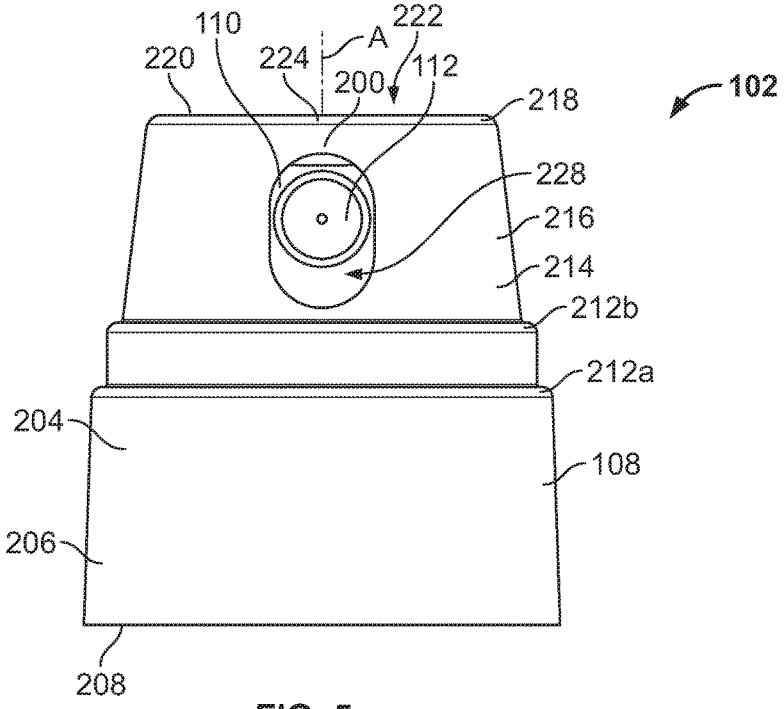
FIG. 5 is a front elevational view of the overcap assembly of FIG. 4.
Figure 6:
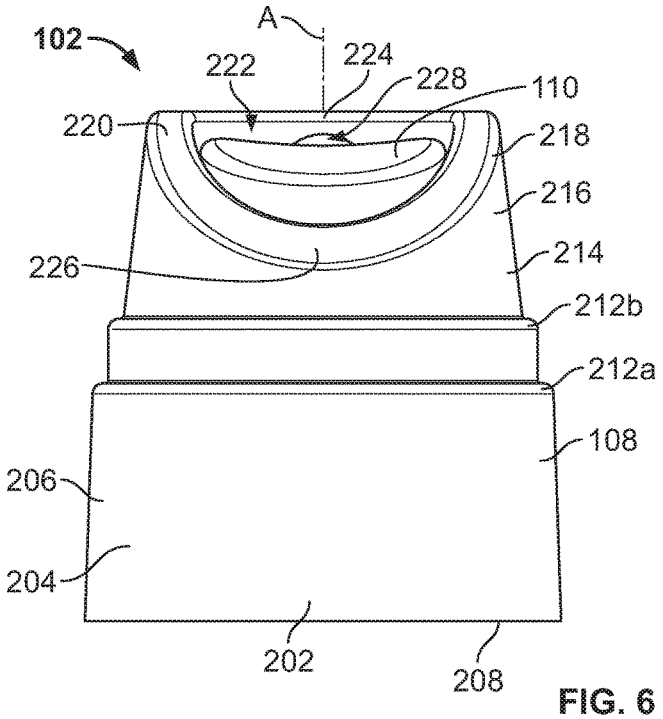
FIG. 6 is rear elevational view of the overcap assembly of FIG. 4.
Figure 7:
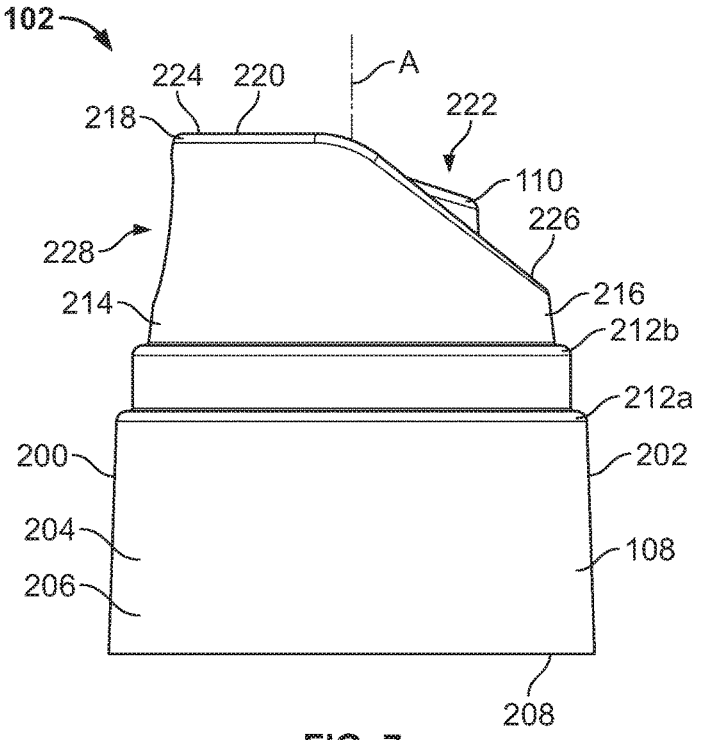
FIG. 7 is a right side elevational view of the overcap assembly of FIG. 4.
Figure 8:
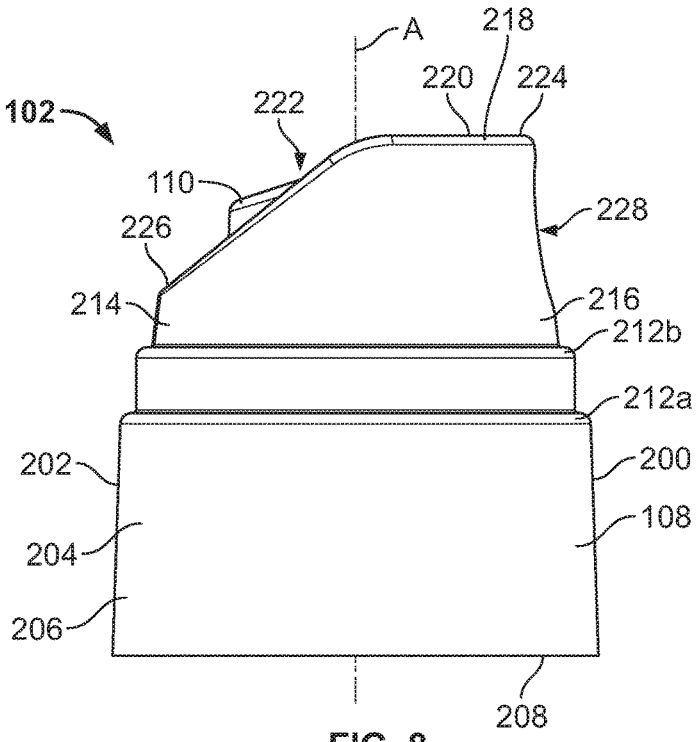
FIG. 8 is a left side elevational view of the overcap assembly of FIG. 4.
Figure 9:
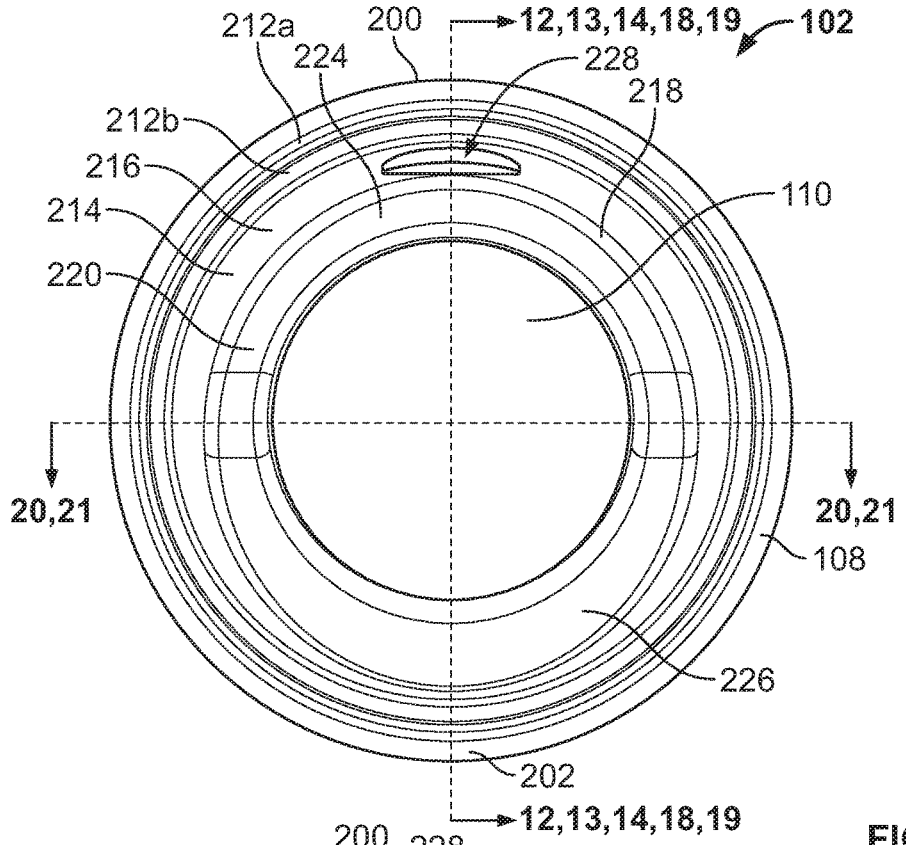
FIG. 9 is a top plan view of the overcap assembly of FIG. 4.

As best seen in FIG. 3, prior to use, the actuator 110 is placed in fluid communication with the distal end 142 of the valve stem 140. A user may manually or automatically operate the actuator 110 to open the valve assembly, which causes a pressure differential between an interior 144 of the container 104 and the atmosphere to force the contents of the container 104 out through an orifice 146 of the valve stem 140, through the overcap assembly 102, and into the atmosphere.

Figure 10:
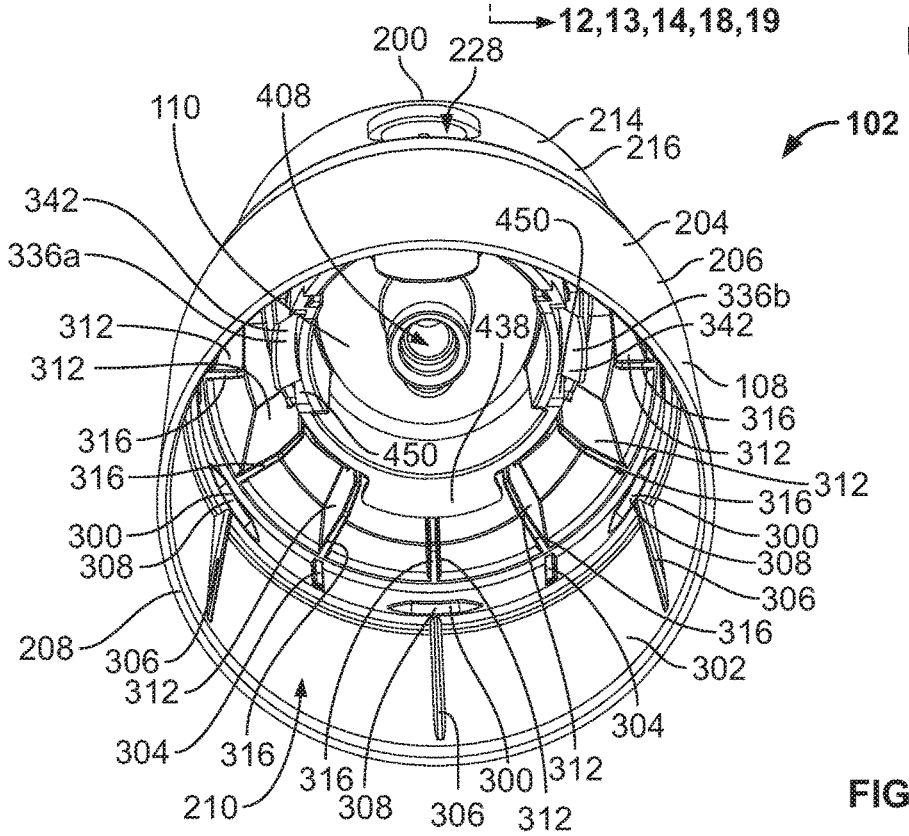
FIG. 10 is a bottom front isometric view of the overcap assembly of FIG. 4.
Figure 11:
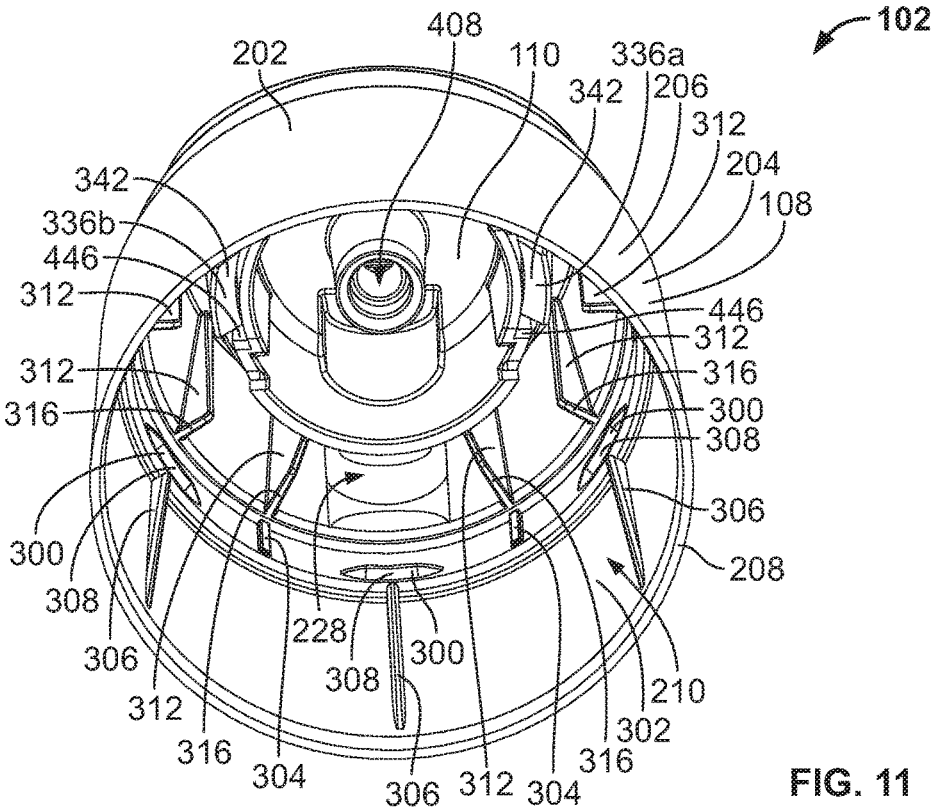
FIG. 11 is a bottom rear isometric view of the overcap assembly of FIG. 4.

Now turning to FIGS. 4-9, the overcap assembly 102 is described with greater particularity. The housing 108 of the overcap assembly 102 is defined as having a front portion 200 and a rear portion 202. The housing 108 includes a truncated frusto-conical lower body 204 comprising a lower sidewall 206 that extends upwardly from a lower edge 208. As illustrated in FIGS. 10 and 11, the lower edge 208 of the lower sidewall 206 is generally circular and defines a lower opening 210 of the housing 108. The lower sidewall may optionally include a lip. Turning again to FIGS. 4-9, the lower sidewall 206 tapers upward and inwardly and includes a series of shoulders 212*a*, 212*b*. The shoulders 212*a*, 212*b* are rounded but may have any shape, including, for example, substantially right angles. One or more intermediate walls are provided between the shoulders 212*a*, 212*b* to adjoin the lower body 204 to an upper body 214 of the housing 108. The upper body 214 includes an upper sidewall 216 that tapers inwardly toward an upper shoulder 218. The upper shoulder 218 is also rounded and adjoins a top wall 220. The top wall 220 includes an upper opening 222. A front section 224 of the top wall 220 is disposed peripherally around the upper opening 222 and is generally perpendicular to the axis A. A rear section 226 of the top wall 220 is also disposed peripherally around the upper opening 222 and slopes downward and outwardly from the front section 224 and the upper opening 222 (see FIG. 6). The upper opening 222 is adapted to receive portions of the actuator 110 as will be described in more detail hereinafter below. The housing 108 further includes a dispensing orifice 228 disposed in the upper sidewall 216 adjacent the front portion 200 of the housing 108, which allows for the emission of product outwardly therethrough.

Turning to FIG. 10, the lower opening 210 of the housing 108 is shown positioned adjacent the lower edge 208 for receiving portions of the container 104. As best seen in FIGS. 10-14, the housing 108 includes a plurality of outwardly extending securement ribs 300 disposed around an interior surface 302 of the lower sidewall 206 of the housing 108. The securement ribs 300 are oriented in a manner such that a longest portion is substantially parallel with the lower edge 208. A plurality of rectilinear protrusions 304 are disposed between the securement ribs 300 and are adapted to limit the rotation of the overcap assembly 102 with respect to the container 104 and/or to allow for variances of different container sizes for use with the overcap assembly 102. In a preferred embodiment, the protrusions 304 limit rotation of the housing 108 with respect to the container 104 because the protrusions 304 have a light interface with the outer diameter of the crown 130 of the container 104. The protrusions 304 may also relieve pressure on the lower sidewall 206 of the housing 108 in the event that a container having a larger diameter (i.e., a diameter that is substantially similar to that of the housing) is inserted into the housing 108 of the overcap assembly 102.

The interior surface 302 of the lower sidewall 206 further includes a plurality of equidistantly spaced elongate secondary guiding ribs 306 that extend radially inward toward the center of the overcap assembly 102. The secondary guiding ribs 306 are substantially parallel with one another and are provided below the securement ribs 300. In a preferred embodiment, an equal number of ribs 300 and 306 are provided, wherein each secondary guiding rib 306 is substantially aligned with a central portion 308 of a corresponding securement rib 300. The interior surface 302 of the upper sidewall 216 of the overcap assembly 102 also includes elongate tertiary stabilizing ribs 312 that extend radially inwardly toward the center of the overcap assembly 102. The tertiary stabilizing ribs 312 are substantially parallel with one another and are provided above the securement ribs 300. In a preferred embodiment, there are between 1 and 2 times as many tertiary stabilizing ribs 312 as there are secondary guiding ribs 306. As illustrated in FIGS. 10-14, some of the tertiary stabilizing ribs 312 are generally aligned with the secondary guiding ribs 306 and other tertiary stabilizing ribs 312 are generally aligned with the rectilinear protrusions 304.

Figure 15:
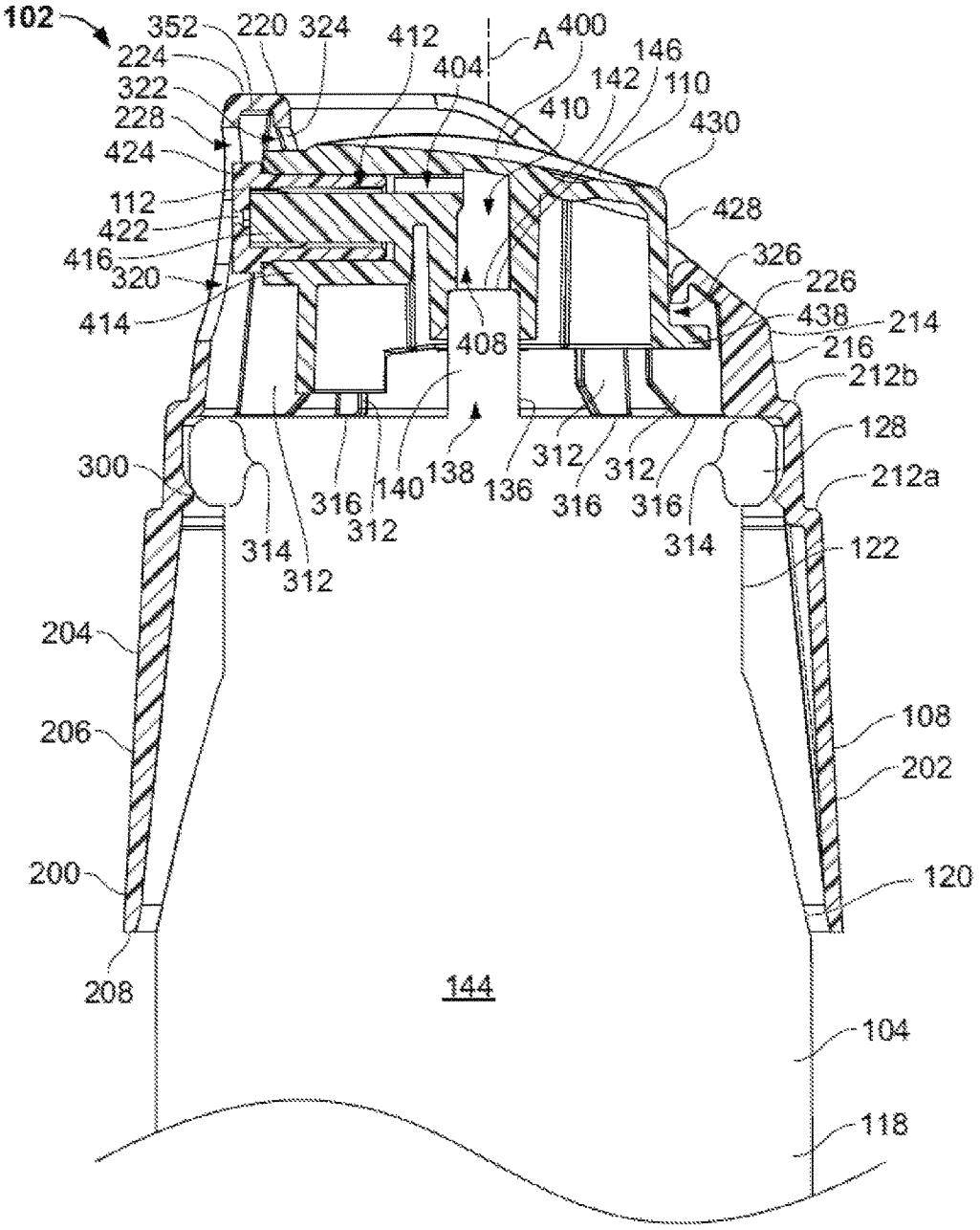
FIG. 15 is a partial, cross-sectional side view of the dispensing system of FIG. 1 taken generally along the line 15-15 shown in FIG. 1.

As best seen in FIG. 15, upon placement of the overcap assembly 102 onto the container 104, the projection 128 thereof is fittingly retained within an annular gap 314 provided between the securement ribs 300 and the tertiary stabilizing ribs 312 in a snap-fit type manner. Any number and size of ribs 300, 306, 312 may be included that circumscribe the interior surface 302 of the sidewalls 206, 216 to assist in attaching the overcap assembly 102 to the container 104. Alternatively, other methods may be utilized to secure the overcap assembly 102 to the container 104 as are known in the art.

The tertiary stabilizing ribs 312 may also provide additional structural integrity to the overcap assembly 102 for allowing retention of the overcap assembly 102. Specifically, bottom surfaces 316 of the tertiary stabilizing ribs 312 interact with portions of the container 104 to assist in spreading forces exerted on upper portions of the housing 108 about the container 104. Further, the tertiary stabilizing ribs 312 assist in aligning and positioning the overcap assembly 102 in the proper position during and/or after the capping process, and increase the top-load and drop performance of the assembly 102. Such alignment assistance helps to ensure that the actuator 110 is positioned correctly onto the valve stem 140.

Figure 12:
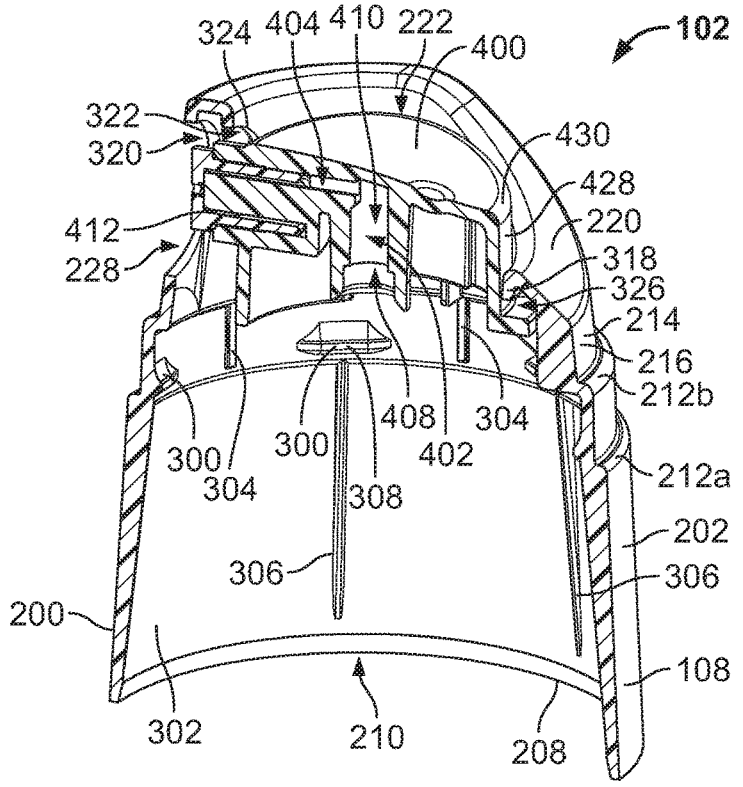
FIG. 12 is a top, rear isometric cross-sectional view of the overcap assembly of FIG. 4 taken along line 12-12 of FIG. 9.
Figure 13:
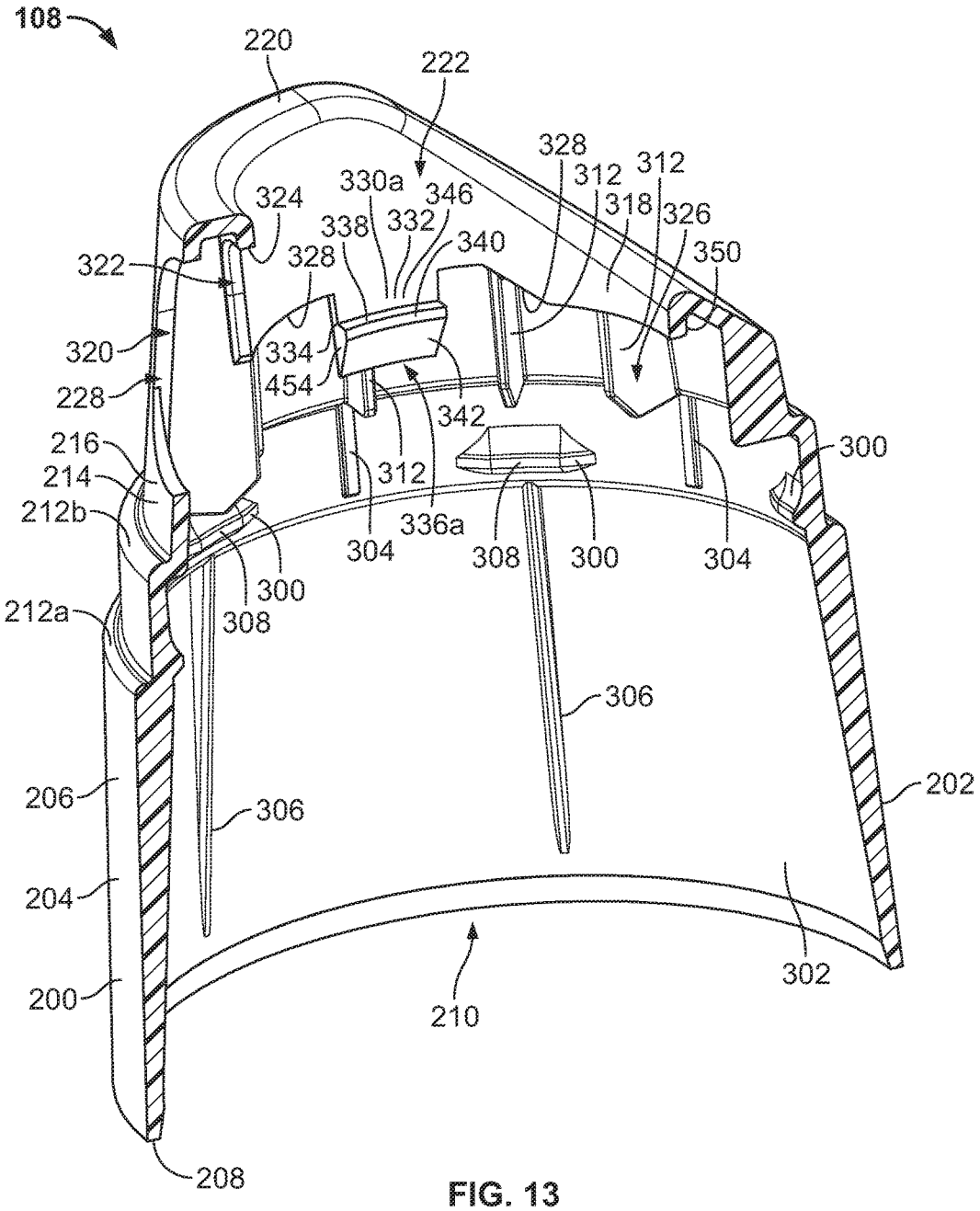
FIG. 13 is a top, front isometric cross-sectional view of the overcap assembly without an actuator or nozzle insert taken along line 13-13 of FIG. 9.
Figure 14:
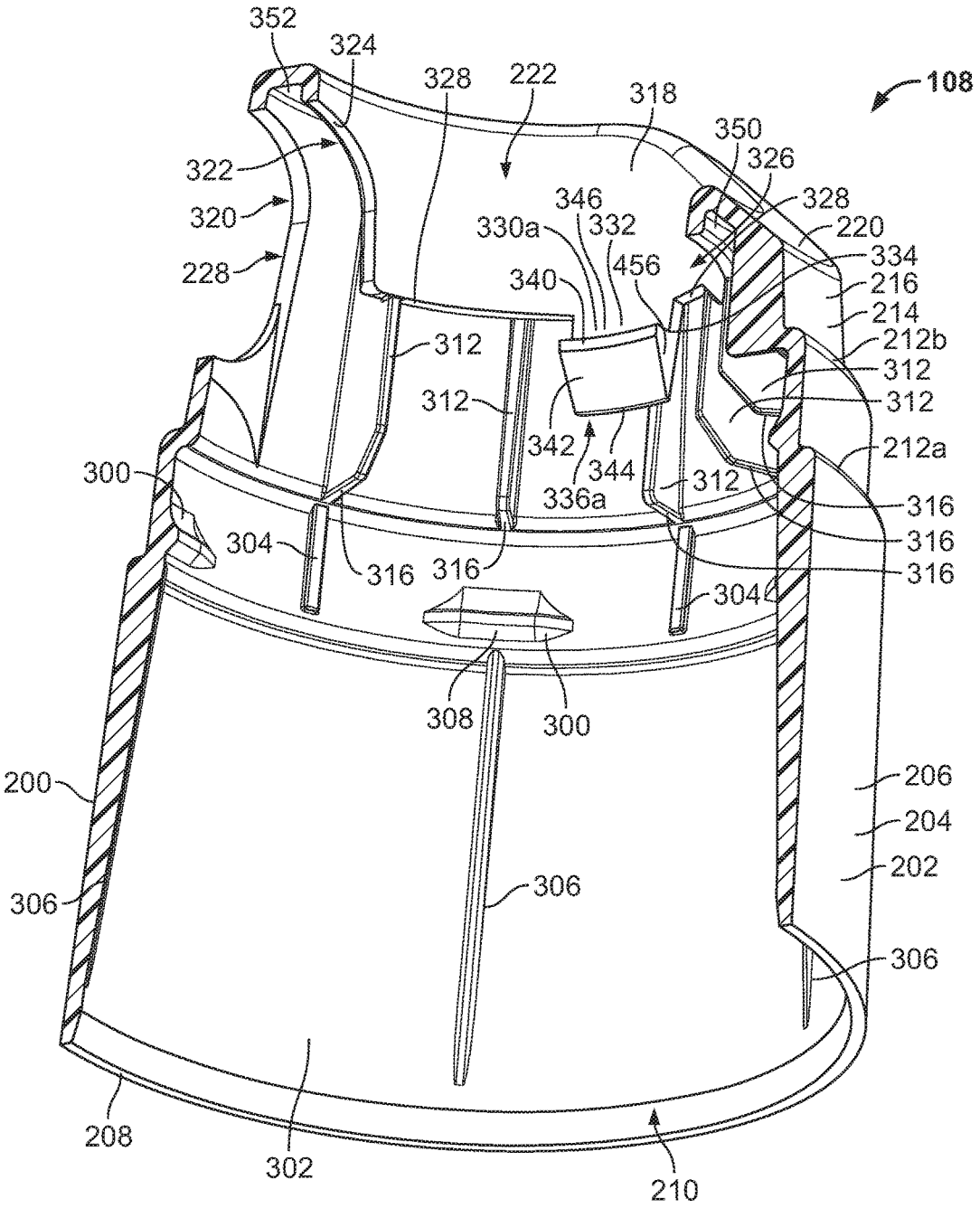
FIG. 14 is a bottom, rear isometric cross-sectional view of the overcap assembly without an actuator or nozzle insert taken along line 14-14 of FIG. 9.

With reference to FIGS. 12-14 an inner wall 318 is provided adjacent the top wall 220 of the housing 108 that helps define the upper opening 222. The inner wall 318 and the upper sidewall 216 of the housing 108 are interrupted at the front portion 200 of the housing 108 by the dispensing orifice 228. The dispensing orifice 228 is defined by an aperture 320 within the upper sidewall 216 and a hole 322 within the inner wall 318. In the illustrated embodiment, the aperture 320 of the upper sidewall 216 is racetrack shaped, and the hole 322 of the inner wall 318 is a truncated racetrack shape. However, both the aperture 320 and the hole 322 may have other shapes or truncated shapes, such as an oval, a square, a triangle, a rectangle, a circle, or any other shape. An upper end 324 of the hole 322 of the inner wall 318 operates as a stop to prevent undesired upward vertical translation or rotation of the actuator 110 as will be described in further detail hereinafter below. The shapes of the aperture 320 and the hole 322 may be similar or may be different depending on the desired function of the housing 108.

As further illustrated in FIGS. 13 and 14, the inner wall 318 of the housing 108 is attached to some of the plurality of tertiary supporting ribs 312. As shown in FIG. 15, the inner wall 318 further includes a notch 326 disposed along the rear portion 202 of the housing 108. The notch 326 may be a cutout formed within the inner wall 318 or the notch 326 may be defined by a combination of one or more surfaces of the inner wall 318 and one or more stabilizing ribs 312. In the illustrated embodiment, the notch 326 is defined by a lower wall edge 328 of the inner wall 318 and by two stabilizing ribs 312. The notch 326 operates as a stop to prevent undesired upward vertical translation or rotation of the actuator 110 such as noted above in connection with the hole 322 and which will be described in further detail hereinafter below. Referring back to FIGS. 13 and 14, the lower wall edge 328 of the inner wall 318 generally forms a lower boundary of the inner wall 318. The lower wall edge 328 may be angled or generally horizontal, depending on the desired structural characteristics of the inner wall 318 and the desired amount of material used to form the housing 108.

Figure 20:
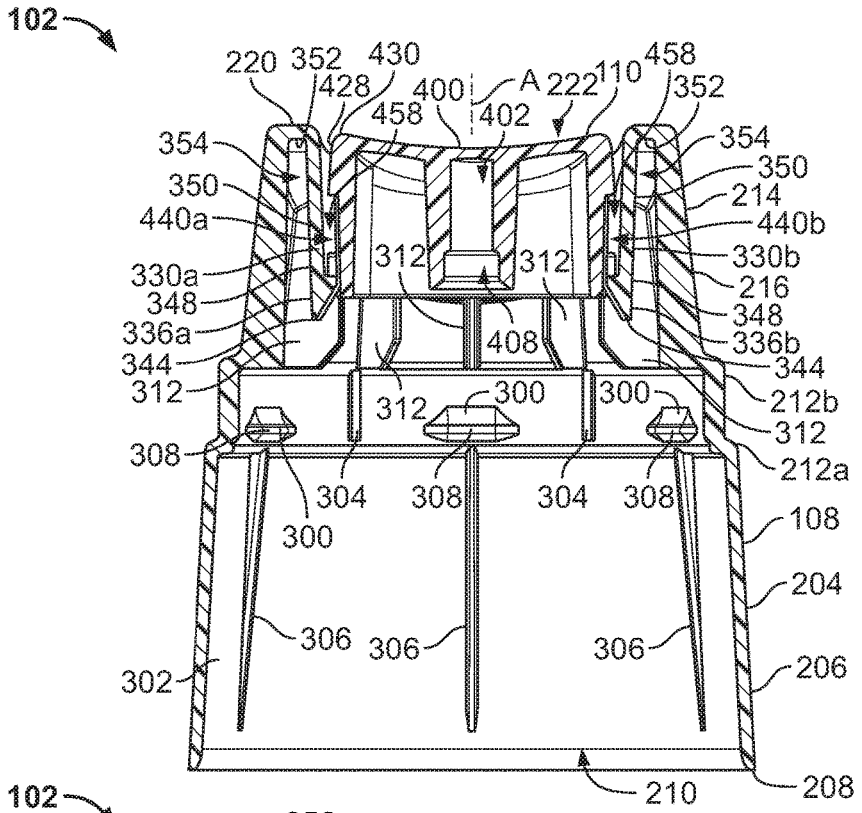
FIG. 20 is a front cross-sectional view of the overcap assembly of FIG. 4 in an inoperative state taken along line 20-20 of FIG. 9.
Figure 21:
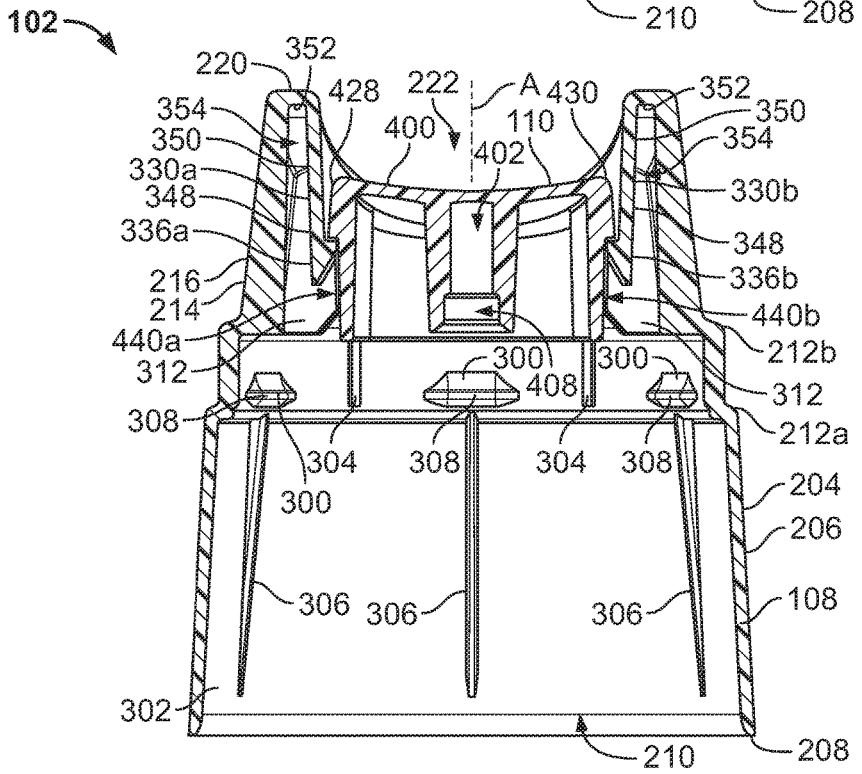
FIG. 21 is a front cross-sectional view of the overcap assembly of FIG. 4 in an operative state taken along line 21-21 of FIG. 9.

Still referring to FIGS. 13 and 14, two similarly shaped elongate flanges 330*a*, 330*b* extend downwardly from the inner wall 318 of the housing 108 (see FIGS. 20 and 21 for 330*b*). The flanges 330*a*, 330*b* are attached to the inner wall 318 at a first end 332. A second end 334 of the flanges 330*a*, 330*b* is spaced from the inner wall 318. In a preferred embodiment, the first end 332 of the flanges 330*a*, 330*b* is connected to the inner wall 318 where the front portion 200 and the rear portion 202 of the housing 108 intersect. The flanges 330*a*, 330*b* extend downwardly and may, in one particular embodiment, extend slightly inwardly toward the center of the overcap assembly 102. The flanges 330*a*, 330*b* have projections 336*a*, 336*b*, respectively. The projections 336*a*, 336*b* are disposed at the second end 334 of the flanges 330*a*, 330*b* and protrude inward toward the center of the overcap assembly 102.

The projections 336*a*, 336*b* include a top face 338, a side face 340, an angled face 342, and a bottom face 344. The top face 338 of the projections 336*a*, 336*b* are generally planar and parallel with the front section 224 of the top wall 220 of the housing 108. The top face 338 of the projections 336*a*, 336*b* intersect with a stop face 346 of the flanges 330*a*, 330*b*, and are formed to receive the actuator 110 when the overcap assembly 102 is in an operative state, as will be described in greater detail hereinafter below. The top face 338 intersects with the side face 340, which is generally perpendicular to the top face 338. The side face 340 intersects the angled face 342. The angled face 342 extends downward and outwardly away from the center of the overcap assembly 102 to intersect with the bottom face 344 of the projections 336*a*, 336*b*. A rear face 348 (see FIGS. 20 and 21) of the flanges 330*a*, 330*b* extends from the bottom face 344 of the projections 336*a*, 336*b* upward to an inner side 350 of the inner wall 318. The inner side 350 of the inner wall 318 extends upward to intersect an underside 352 of the top wall 220 of the housing 108. The faces, 338, 340, 342, 344 of the projections 336*a*, 336*b* and the faces 346, 348 of the flanges 330*a*, 330*b* may have alternate configurations or may be excluded entirely from the projections 336*a*, 336*b* and flanges 330*a*, 330*b*.

As illustrated in FIG. 20, a gap 354 is formed between the rear face 348 of each of the flanges 330*a*, 330*b* and the interior surface 302 of the upper sidewall 216. The gap 354 allows the flanges 330*a*, 330*b* to flex and act as a hinge both during assembly of the overcap assembly 102 and during the actuation process. A smallest width of the gap 354 is preferably at least about 0.2 mm. In a particular embodiment, a preferred range of the gap 354 is between about 0.2 mm and about 8 mm, more preferably about 0.8 mm to about 5 mm, and most preferably about 1 mm. The spacing of the gap 354 is specifically sized to allow the appropriate amount of flexing of the flanges 330*a*, 330*b* while still providing the guiding functions as discussed herein. The size of the gap 354 may be adjusted to an appropriate size such that the advantages described herein may be realized. Various manufacturing considerations may be taken into account such as the container size, the overcap size, the type of product being dispensed, the actuator size, the manufacturing materials of the components, and the like.

In a preferred embodiment, the neck 122 of the container 104 has a diameter of between about 17 mm and about 40 mm, or between about 25 mm and about 35 mm, or about 29 mm. Further, an outermost edge of the projection 128 preferably has a diameter measured through the axis A of between about 20 mm and about 40 mm, or between about 25 mm and about 35 mm, or about 33 mm. Still further, the crown 130 preferably has a diameter of between about 20 mm and about 40 mm, or between about 25 mm and about 35 mm, or about 33 mm. In still a further embodiment, the valve stem 140 has a height from the planar surface 134 of the container 104 (or from an upper end of a pedestal the valve stem extends from) to the distal end 142 of the valve stem 140 of between about 5.0 mm and about 8.5 mm, or between about 5.49 mm and about 8.15 mm, or about 7.0 mm. Further, it is contemplated that there may be variability in the height of the valve stem due to allowable manufacturing tolerances or from changes in the valve stem height over the use of the container, e.g., a container with compressed gas loses about 1 mm in valve stem height over the lifetime thereof. Still further, the variability in valve stem height causes issues with conventional hinging systems, thereby providing additional reasons that the present overcap solutions are beneficial.

Referring to FIGS. 16-21, the actuator 110 includes a button 400 which may be made of any one of the aforementioned materials associated with the overcap assembly 102. The button 400 includes a vertical conduit 402 (see FIGS. 18-21) and a horizontal conduit 404 (see FIGS. 18 and 19). The conduits 402, 404 may similarly be made of any one of the aforementioned materials associated with the overcap assembly 102. The button 400 is integral with the vertical conduit 402 and the horizontal conduit 404. The horizontal conduit 404 is in fluid communication with the vertical conduit 402 at a juncture 406 (see FIGS. 18 and 19). The vertical conduit 402 is in fluid communication with the valve stem 140 of the container 104 during use of the dispensing system 100. The vertical conduit 402 includes an inlet orifice 408 that is sized to receive the valve stem 140 of the container 104.

Still referring to FIGS. 16-21, the button 400 and/or the conduits 402, 404 may be made of the same material or may be made of different materials. For example, while it is contemplated that the conduits 402, 404 are formed from the same materials in one particular embodiment, it is also envisioned that one or more portions of one or both of the conduits 402, 404 could be fashioned from differing materials to alter the flexibility of the conduits. While may be formed of the same materials while other portions of the conduits 402, 404 may be formed of different materials. During vertical actuation of the actuator 110, it may be desirable for one or both of the conduits 402, 404 to have no flexure or to have some flexure. It may alternatively be desirable to have some flexure in light of having a larger container footprint that allows for a wider range of motion of the conduits 402, 404. The flexure may be a result of the material used for one or both of the conduits 402, 404, wherein the flexure could be the same due to the same material being used or could be different due to different materials being used, due to different thicknesses of the materials that make up the conduits 402, 404, or due to the possibility of a thinned hinge portion positioned at the intersection of the conduits 402, 404. The inlet orifice 408 allows fluid to pass through a passageway 410 that extends through the conduits 402, 404 to a nozzle outlet or discharge conduit 412 (see FIGS. 18 and 19). The discharge conduit 412 is annular in configuration and includes an outer portion 414 and an inner portion 416, such as a post. The discharge conduit 412 fittingly receives the nozzle insert 112. The nozzle insert 112 may be fashioned in numerous configurations as known to those of skill in the art. It is contemplated that the nozzle insert 112 may be provided with any number of channels, ribs, or other structure to assist in breaking up the discharge fluid into a mist with an application-appropriate spray pattern and particle size.

It is also contemplated that the nozzle insert 112 may include a swirl chamber in fluid communication with one or more downstream recesses to assist in discharging fluid. Further, it is anticipated that the nozzle insert 112 may impart one or more characteristics to the fluid including, but not limited to, a modification of the particle size of the fluid, a spray pattern of the fluid, a velocity of the fluid, a discharge rate of the fluid, or any other physical or chemical property of the fluid. In use, fluid flows from the passageway 410 to the discharge conduit 412. Thereafter, fluid enters the annular passage of the discharge conduit and is ejected through an outlet or outlet orifice 422 disposed at an outlet end 424 of the nozzle insert 112. In an alternative embodiment, the outlet orifice 422 is not be disposed on the nozzle insert 112; rather, the outlet orifice 422 is part of the actuator 110. The outlet orifice 422 is generally circular in shape, but may be any other geometric shape. Various other components as known in the art may be optionally included in the passageway 410 or nozzle insert 112 to affect the fluid as is known to those skilled in the art.

Figure 16:
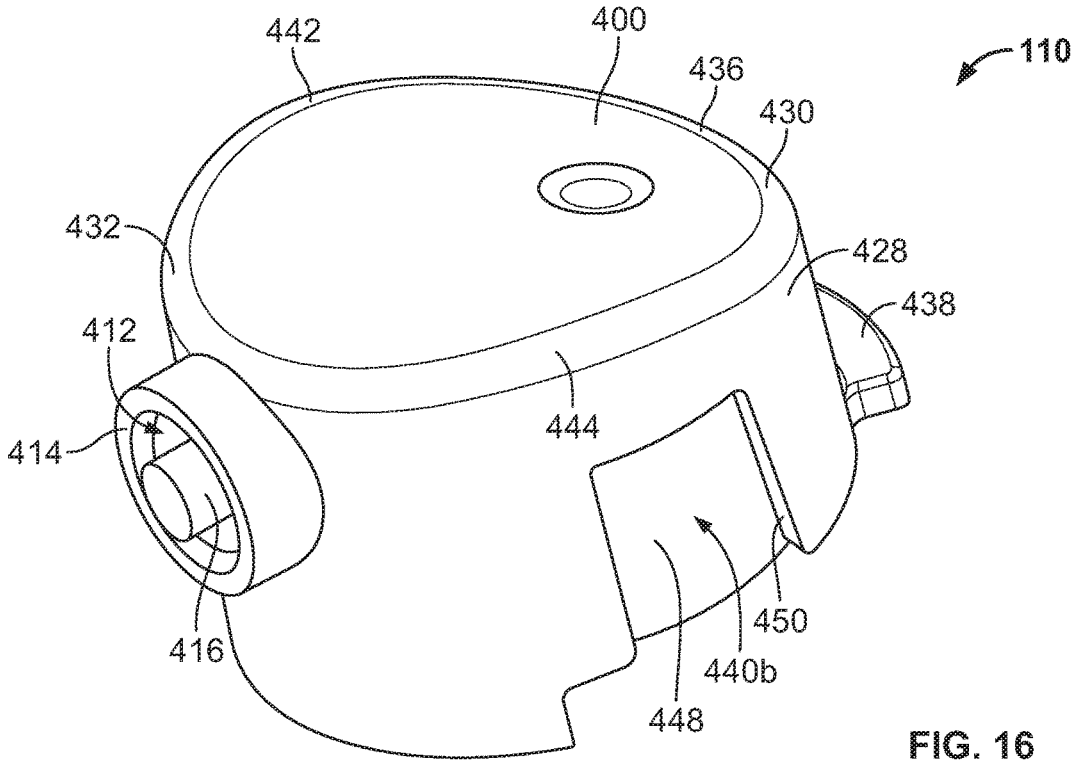
FIG. 16 is a top front isometric view of the actuator of the overcap assembly of FIG. 4.
Figure 17:
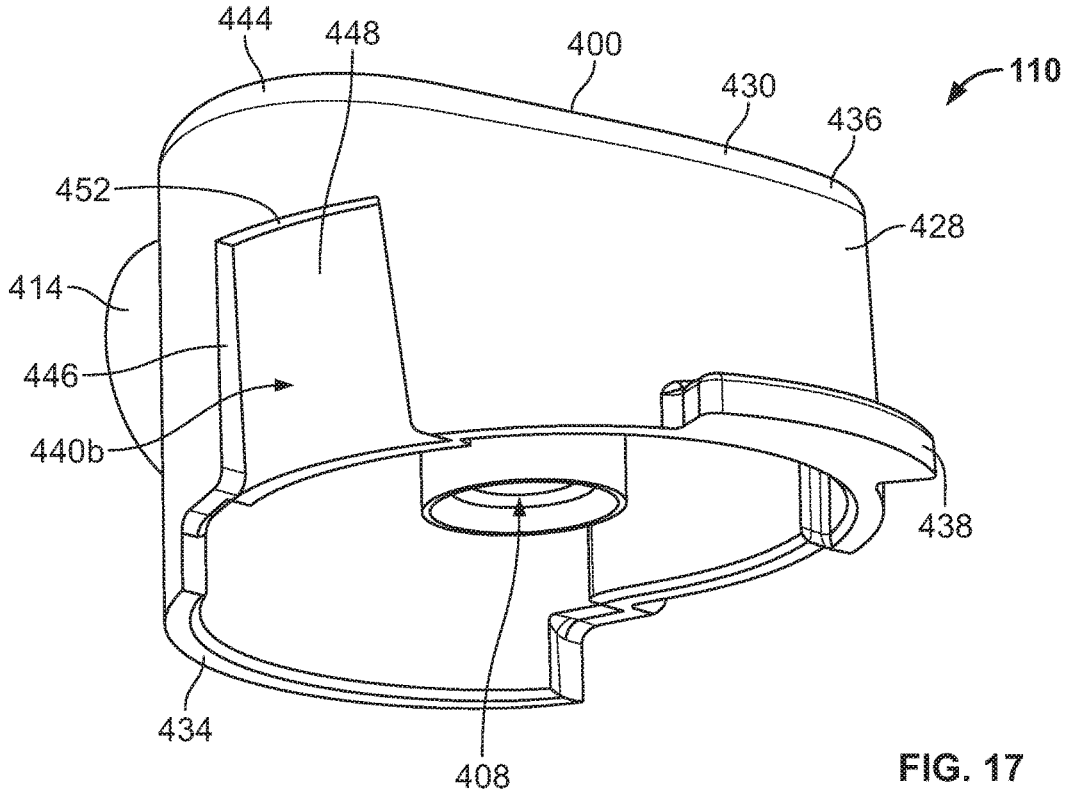
FIG. 17 is a bottom rear isometric view of the actuator of FIG. 16.

Referring to FIGS. 16 and 17, the actuator 110 includes an outer wall 428 that intersects with the button 400 at a rounded corner 430. The outer wall 428 of the actuator 110 runs peripherally about the actuator 110 and is intersected by the nozzle conduit 412 at a front end 432 thereof. The outer wall 428 includes a lower edge 434. The actuator 110 further includes a rear end 436 located opposite the front end 432 thereof. A tab 438 protrudes outwardly from the lower edge 434 of the actuator 110 at the rear end 436 thereof. The tab 438 is generally perpendicular to the outer wall 428 of the actuator 110. The tab 438 is formed to be received by the notch 326 of the housing 108 to prevent upward vertical translation of the actuator 110 as will be described hereinafter below. When the overcap assembly 102 is assembled, the tab 438 is bounded on either side by adjacent stabilizing ribs 312, which limit rotational movement of the actuator 110 with respect to the housing 104. The tab 438 may be one unitary piece or may be multiple pieces. The tab 438 may further be located at any point along the lower edge 434 of the outer wall 428 of the actuator 110 or, in other embodiments, distal from the lower edge 434. It is also contemplated that the tab 438 may be a separate piece that is detachable from the actuator 110.

In a preferred embodiment, the diameter of the button 400 is between about 5 mm and about 50 mm, or between about 10 mm and about 40 mm, or between about 15 mm and about 35 mm, or about 20 mm. The height of the housing 108, measured from the lower edge 208 of the housing 108 to the front section 224 of the top wall 220 of the housing 108 is about 46 mm or between about 25 mm and about 70 mm. The diameter of the lower edge 208 of the housing 108 is preferably about 40 mm or between about 20 mm and about 70 mm.

With reference still to FIGS. 16 and 17, the actuator 110 is shown without the nozzle insert 112 or the housing 108. The actuator 110 includes a left slot 440*a* (shown in FIG. 20 or 21) and a right slot 440*b*, which are located on a left portion 442 and a right portion 444 of the actuator 110, respectively. The slots 440*a*, 440*b* are defined by a front guide face 446, a side guide face 448, a rear guide face 450, and a stop face 452. The side guide face 448 is generally parallel with, but offset from, the outer wall 428 of the actuator 110. The front guide face 446, the stop face 452, and the rear guide face 450 extend generally perpendicularly outward from the side guide face 448. During use of the overcap assembly 102, the front guide face 446 is disposed in the direction of the front portion 200 of the housing 108 while the rear guide face 450 is disposed in the direction of the rear portion 202 of the housing 108. The slots 440*a*, 440*b* are generally formed to receive the projections 336*a*, 336*b*, respectively, of the housing 108 to prevent both substantial downward vertical translation and rotation about axis A of the actuator 110. Specifically, the stop face 452 of the slots 440*a*, 440*b* acts as a stop and engages with the top face 338 of the projections 336*a*, 336*b*, respectively, to prevent inadvertent downward vertical translation of the actuator 110 during an actuated state as described in further detail hereinafter below. To prevent substantial rotation of the actuator 110 about the axis A, the front guide face 446 of the slots 440*a*, 440*b* of the actuator 110 engages with a front face 454 (see FIG. 13) of the projections 336*a*, 336*b* of the housing 108 and the rear guide face 450 of the slots 440*a*, 440*b* of the actuator 110 engages with a back face 456 (see FIG. 14) of the projections 336*a*, 336*b* of the housing 108.

To place the overcap assembly 102 into an operable condition, the actuator 110 is slid through the lower opening 210 of the housing 108 with the tab 438 of the actuator 110 being aligned with the notch 326 of the housing 108, and the slots 440*a*, 440*b* of the actuator 110 being aligned with the projections 336*a*, 336*b* of the housing 108, respectively. After alignment, the actuator 110 is pressed upward such that the rounded corner 430 of the actuator 110 engages with the angled face 342 of the projections 336*a*, 336*b* of the housing 108. The pressing of the actuator 110 against the angled face 342 of the projections 336*a*, 336*b* thereby forces the projections 336*a*, 336*b* outward, away from the center of the overcap assembly 102, until the actuator 110 is as shown in FIG. 21, wherein the projections 336*a*, 336*b* of the housing 108 are disposed within the slots 440*a*, 440*b* of the actuator 110. After engagement of the actuator 110 with the housing 108, the discharge conduit 412 is centrally aligned with the racetrack shaped aperture 320 of the housing 108. When the discharge conduit 412 is so disposed, the nozzle insert 112 is fitted within the discharge conduit 412. The securement of the actuator 110 within the overcap assembly 102 allows the container 104 to be mated to the overcap assembly 102 and provides for proper alignment during the assembly process, which reduces the possibility of misalignment and breakage of the actuator 110 or valve stem 140, and prevents accidental activation during the capping operation.

The assembled overcap assembly 102 is thereafter seated and retained on the container 104 in a similar manner as noted above, i.e., ribs 300, 306, 312 of the housing 108 interact with the projection 128 of the container 104 to secure the overcap assembly 102 to the container 104 in a snap-fit type manner. In this condition, the button 400 of the actuator 110 extends upwardly through the housing 108 and out through the upper opening 222 disposed in the top wall 220 of the housing 108. When seated properly, the button 400 extends up through the upper opening 222 to create a surface on which a user can apply pressure to effectuate the actuation process. Further, in this condition, the valve stem 140 of the container 104 is seated within the inlet orifice 408, whereby surfaces defining the inlet orifice 408 and the valve stem 140 provide a substantially fluid tight seal therebetween. The dimensions and placement of the valve stem 140, the ribs 300, 306, 312, and the actuator 110 are critical in maintaining a proper fluid seal between the vertical conduit 402 and the valve stem 140 and in preventing misalignment of the actuator 110 with the dispensing orifice 228. In conventional overcap construction, varying manufacturing tolerances typically resulted in defective overcap assemblies, wherein the alignment of the aforementioned components resulted in broken components, premature evacuation of the container, or improper spray angles. For example, if the valve stem in a conventional overcap was manufactured with a height component larger than the overcap was designed for, seating the overcap on the container may result in breaking the valve stem or actuator, accidental evacuation of the contents of the container, and/or the misalignment of the dispensing orifice to spray at an improper angle or within the overcap itself.

Various advantages are realized by the dispensing system 100 when the actuator 110 is inserted into the housing 108 and retained therein. Specifically, the securement of the actuator 110 within the housing 108 results in the button 400 being disposed below the front portion 200 of the top wall 220 of the housing 108, which substantially prevents lifting of the button by a user. Furthermore, the actuator 110 behaves as a floating actuator, thus, the setup of the overcap assembly 102 compliments a wide range of valve stem heights, thereby allowing for a wide range of bottles or containers to be used with the overcap assembly 102.

In use, the fluid is sprayed from the dispensing system 100 by exerting a force on the actuator 110. The force causes the actuator 110 to vertically translate so that the inlet orifice 408 is moved from a non-actuation position to an actuation position. In a preferred embodiment, the actuator 110 translates between about 0.5 mm and about 10 mm, or between about 1 mm and about 8 mm from the non-actuation position to the actuation position. Upon removal of force from the actuator 110, the inlet orifice 408 returns to the non-actuation position. The actuator 110 is moved to the non-actuation position by the force of the valve stem 140 moving upwardly by the valve spring to close the valve assembly within the container 104.

Figure 18:
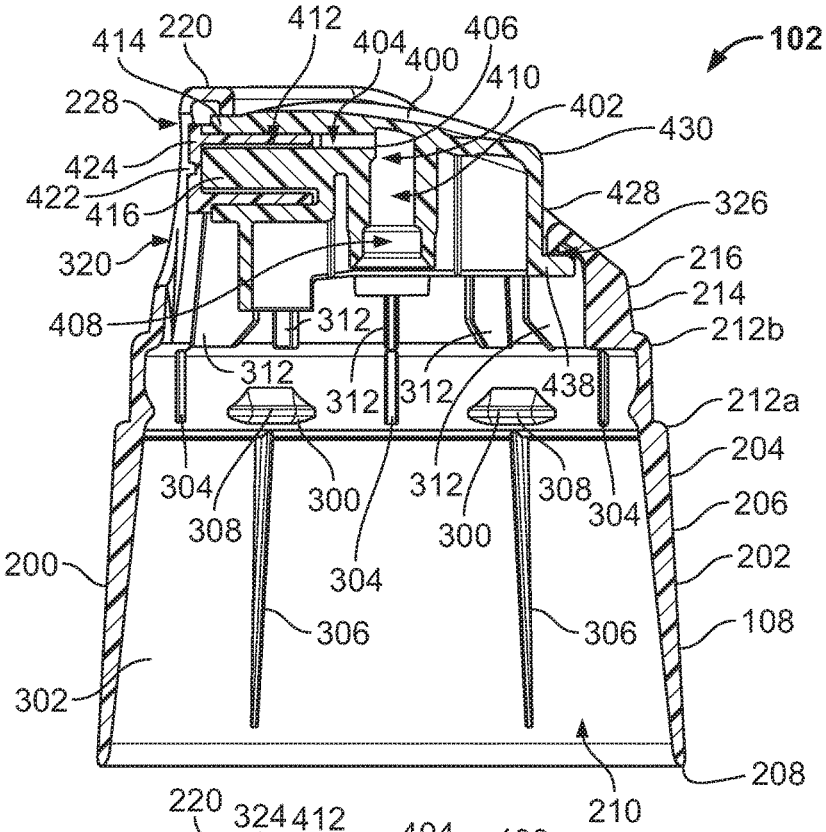
FIG. 18 is a side cross-sectional view of the overcap assembly of FIG. 4 in an inoperative state taken along line 18-18 of FIG. 9.
Figure 19:
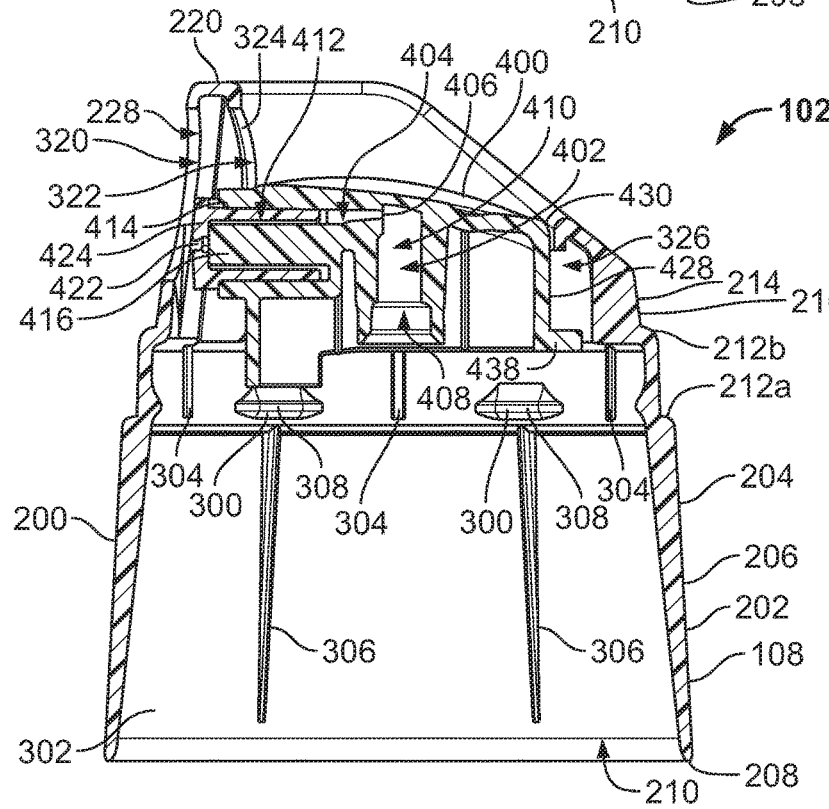
FIG. 19 is a side cross-sectional view of the overcap assembly of FIG. 4 in an operative state taken along line 19-19 of FIG. 9.

With specific reference to FIGS. 18-21, the overcap assembly 102 is shown in cross-section in a non-actuation state (see FIGS. 18 and 20) and an actuation state (see FIGS. 19 and 21). It should be noted that the overcap assembly 102 depicted in FIGS. 19 and 21 in the actuation state is shown in a fully actuated state. However, depending on the tolerance or specific characteristics of the container and/or valve stem and accompanying valve assembly, it is possible that spraying may be effected either fully or partially by pressing the actuator downward somewhere between the two positions shown in FIGS. 18 and 20 (non-actuated) and FIGS. 19 and 21 (fully actuated). However, for purposes of explaining the functionality and interaction of the actuator 110 with the housing 108, the term "actuation state" as it relates to the overcap assembly 102 shown in FIGS. 19 and 21 refers to what is, in fact, a fully actuated state of the overcap assembly 102.

As illustrated in the side cross-sectional views of FIGS. 18 and 19, exerting a force on the button 400 of the actuator 110 of the dispensing system 100 translates the actuator 110 from the non-actuation state (FIG. 18) to the actuation state (FIG. 19). When the actuator 110 is translated from the non-actuation state, the outlet orifice 424 of the actuator 110 is moved from a first position to a second position. As shown in FIG. 18, when the overcap assembly 102 is in the non-actuation state, portions of the discharge conduit 412 are in contact or engaged with surfaces defining the hole 322 of the inner wall 318 of the housing 108. Further, the tab 438 of the actuator 110 is in contact or engaged with surfaces defining the notch 326 of the inner wall 318 of the housing 108. The actuator 110 remains in the non-actuation state due to the force of the valve spring (not shown) until a user presses down on the button 400 of the actuator 110 to translate the actuator 110 from the non-actuation state to the actuation state.

Referring now to FIG. 19, the actuator 110 is shown translated vertically downward to the actuation state. Throughout the translation of the actuator 110 from the non-actuation state to the actuation state, the outlet orifice 424 of the nozzle insert 112 is disposed in substantial alignment with the racetrack shaped aperture 320 of the housing 108. A substantially fluid tight connection is maintained between the inlet orifice 408 and the valve stem 140 of the container 104 during the non-actuation state and the actuation state. As shown in FIG. 19, when the actuator 110 is depressed to the actuation state, the discharge conduit 412 is no longer in contact or engaged with surfaces defining the hole 322 of the inner wall 318 of the housing 108. Further, the tab 438 is no longer in contact or engaged with surfaces defining the notch 326. The actuator 110 remains in the actuation state due to the downward force of a user until the user releases the button 400 of the actuator 110 to allow vertical translation of the actuator 110 from the actuation state (FIG. 19) back to the non-actuation state (FIG. 18).

Now turning to FIGS. 20 and 21, a front cross sectional view of the overcap assembly 102 is shown, with the overcap assembly 102 shown in a non-actuation state in FIG. 20 and an actuation state in FIG. 21. As illustrated in FIG. 20, when the overcap assembly 102 is in the non-actuation state, a space 458 is formed between the stop face 452 (see FIG. 17) of the slots 440*a*, 440*b* of the actuator 110 and the top face 338 (see FIG. 13) of the projections 336*a*, 336*b* of the housing 108. As previously described, the actuator remains in the non-actuation state due to the engagement of the discharge conduit 412 with the surfaces defining upper end 324 of the hole 322 and the engagement of the tab 438 of the actuator 110 with surfaces defining the notch 326. As also previously noted, the actuator 110 remains in the non-actuation state until a user presses down on the button 400 of the actuator 110 to translate the actuator 110 from the non-actuation state to the actuation state.

Referring now to FIG. 21, the actuator 110 is shown translated vertically downward to the actuation state. Throughout the translation of the actuator 110 from the non-actuation state to the actuation state, the projections 336*a*, 336*b* of the housing 108 are substantially retained between the front guide face 446 and the rear guide face 450 of the slots 440*a*, 440*b* of the actuator 110, which prevents rotational movement of the actuator 110 about the axis A. As shown in FIG. 21, when the actuator 110 is depressed to the actuation state, the stop face 452 of the slots 440*a*, 440*b* of the actuator 110 and the top face 338 of the projections 336*a*, 336*b* are engaged. The engagement of the stop face 452 (see FIG. 17) of the slots 440*a*, 440*b* with the top face 338 (see FIG. 13) of the projections 336*a*, 336*b*, respectively, prevents undesired downward vertical translation of the actuator 110. The actuator 110 remains in the actuation state until a user releases the button 400 of the actuator 110 to allow translation of the actuator 110 from the actuation state (FIG. 21) back to the non-actuation state (FIG. 20).

As previously noted, containers having a relatively small footprint are not compatible with prior art overcap assemblies that require a larger range of motion for actuation due to the actuating mechanisms disposed therein, such as hinges and other rotatable mechanisms. In fact, the smaller footprint of such containers, e.g., the smaller container necks, preclude utilization of a hinging or rotatable mechanism in such a space without extending beyond a peripheral boundary of the neck. The system described herein is optimal for containers having a neck diameter less than or equal to 40 mm due to the limited components available to actuate the overcap assembly when a force by a user is applied. Because the overcap assembly disclosed herein is designed for use with containers having a relatively small neck, i.e. having a neck diameter less than or equal to 40 mm, a relatively limited range of actuation angles are possible. However, it is contemplated that the overcap assembly 102 disclosed herein may be mated with a container that has a non-vertical valve assembly or with a valve stem that requires angular motion for actuation. Further, while the teachings of the present overcap assemblies are particularly beneficial to containers having smaller footprints, the present embodiments could be utilized with any size container.

Any of the embodiments described herein may be modified to include any of the structures or methodologies disclosed in connection with different embodiments. Further, the present disclosure is not limited to aerosol containers of the type specifically shown. Still further, the overcaps of any of the embodiments disclosed herein may be modified to work with any type of aerosol or non-aerosol container.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. An overcap assembly, comprising:
an actuator including:
a first slot;
a tab;
a spray passageway; and
an outlet in fluid communication with the spray passageway; and
a housing having:
a sidewall;
an inner wall spaced apart from the sidewall; and
a top wall adjoining the sidewall and the inner wall,
wherein a notch is provided within the inner wall to receive the tab during a non-actuation state, and a first projection extends from the inner wall to be received by the first slot during an actuation state.

2. The overcap assembly of claim 1, wherein the notch is provided on a front side or a rear side of the housing.

3. The overcap assembly of claim 1, wherein the inner wall includes a hole for receipt of a portion of the actuator during the non-actuation state.

4. The overcap assembly of claim 1, wherein the housing includes a second projection and the actuator includes a second slot, wherein the second projection is received by the second slot during the actuation state.

5. The overcap assembly of claim 4, wherein the first projection is provided on a side of the housing and the second projection is provided on an opposing side of the housing.

6. The overcap assembly of claim 5, wherein the projection includes a first top face and the second projection includes a second top face, and the first slot includes a first stop face that receives the first top face and the second projection includes a second stop face that receives the second top face.

7. The overcap assembly of claim 1, wherein the housing includes an inner wall and an outer wall, the inner wall including a hole to receive a nozzle insert and the outer wall including a racetrack shaped aperture.

8. The overcap assembly of claim 1, wherein a nozzle insert is disposed within a discharge conduit of the actuator.

9. The overcap assembly of claim 8, wherein the spray passageway further includes a valve stem inlet for receipt of a valve stem of a container.

10. An overcap assembly, comprising:
a housing having an inner wall and a sidewall spaced apart from the inner wall, wherein a top wall is connected to the inner wall and the sidewall;
a dispensing orifice provided within the sidewall;
a first projection extending from a first flange of the inner wall;
a first notch provided within the inner wall;
an actuator having a first slot to receive the first projection during an actuation state; and
a tab to be received by the notch during a non-actuation state.

11. The overcap assembly of claim 10, wherein the actuator further includes a discharge conduit.

12. The overcap assembly of claim 11 further including a nozzle insert disposed within the discharge conduit.

13. The overcap assembly of claim 10 further including a second projection extending from a second flange of the inner wall, wherein the actuator further includes a second slot to receive the second projection during the actuation state.

14. The overcap assembly of claim 13, wherein the first projection and the second projection protrude inwardly toward a center of the overcap assembly.

15. The overcap assembly of claim 14, wherein the first projection and the second projection include angled surfaces that allow the actuator to be slidingly engaged with the housing during assembly.

16. The overcap assembly of claim 10, wherein the tab extends radially outward from a center of the overcap assembly.

17. A method of seating an overcap assembly on a container, comprising the steps of:

providing a housing having a sidewall, an inner wall spaced apart from the sidewall, and a top wall connected to the sidewall and the inner wall, wherein a notch is provided within the inner wall, and wherein first and second flanges of the inner wall have first and second projections extending therefrom, respectively;

providing an actuator, which includes a conduit with an outlet orifice and a valve seat, wherein first and second slots are disposed on opposite sides of the actuator, and wherein a tab is disposed on the actuator;

positioning the first and second projections within the first and second slots, respectively, so that first and second flat faces of each projection are engageable with first and second stop faces of each slot to assist in inhibiting substantial vertical translation; and positioning the tab within the notch so that the tab is engageable with a lower wall edge that partially defines the notch.

18. The method of claim 17 further comprising the step of:

placing the outlet orifice of the conduit in substantial alignment with the dispensing orifice of the overcap.

19. The method of claim 18 further comprising the step of:

mating the overcap to a container, whereby a valve stem is seated within the valve seat of the conduit.

* * * * *